US005809569A

United States Patent [19]

Bruno et al.

[11] Patent Number: 5,809,569

[45] Date of Patent: Sep. 22, 1998

[54] DEVICE FOR SECURING A GLOVE OR MITTEN TO THE HAND

[76] Inventors: Beth Ann Bruno; Michael J. Bruno, both of 1130 Rte. 14, Penn Yan, N.Y. 14527

[21] Appl. No.: 748,238

[22] Filed: Nov. 12, 1996

[51] Int. Cl.[6] ..... A41D 19/00; A41D 20/00

[52] U.S. Cl. ..... 2/159; 2/158; 2/160; 2/170

[58] Field of Search ..... 2/16, 21, 159, 2/158, 161.6, 161.7, 162, 163, 161.1, 161.2, 160, 170, 313, 312, 161.4, 169, 338; 602/64, 21, 22, 62; 473/205, 212, 213; D2/610, 614, 617, 618, 621, 622, 623

[56] References Cited

U.S. PATENT DOCUMENTS

| | | | |
|---|---|---|---|
| 1,106,708 | 8/1914 | Hazard | 2/159 |
| 1,361,565 | 12/1920 | Christy | 2/313 |
| 1,790,381 | 1/1931 | Keller . | |
| 2,288,150 | 6/1942 | Wyman | 2/170 |
| 2,388,330 | 11/1945 | Jungmann | 2/16 |
| 2,496,808 | 2/1950 | Moore | 2/161.2 |
| 2,709,257 | 5/1955 | McKinney | 2/16 |
| 3,062,546 | 11/1962 | Horton et al. | 2/161.1 |
| 3,100,302 | 8/1963 | Billings | 2/160 |
| 3,178,724 | 4/1965 | Perschke | 2/16 |
| 3,232,632 | 2/1966 | Lewis | 2/160 |
| 3,238,939 | 3/1966 | Stubbs | 128/165 |
| 3,411,159 | 11/1968 | Berkhemer | 2/159 |
| 3,726,525 | 4/1973 | Jackson | 2/161.6 |
| 3,815,908 | 6/1974 | Hashimoto | 273/54 B |
| 3,880,426 | 4/1975 | Morse | 2/170 |
| 3,896,498 | 7/1975 | Pang | 473/205 |
| 4,584,993 | 4/1986 | Nelson | 602/21 |
| 4,698,850 | 10/1987 | Patton, Sr. et al. | 2/159 |
| 4,730,354 | 3/1988 | Saito | 2/161 A |
| 4,793,005 | 12/1988 | Hetzel, Jr. | 2/162 |
| 4,883,073 | 11/1989 | Aziz | 602/21 |
| 4,938,487 | 7/1990 | Ponsart | 2/170 |
| 5,004,231 | 4/1991 | Alread | 273/143 |
| 5,022,094 | 6/1991 | Hames et al. | 2/160 |
| 5,064,198 | 11/1991 | Szabo | 273/189 R |
| 5,110,154 | 5/1992 | Street | 2/170 |
| 5,214,798 | 6/1993 | McLaughlin | 2/160 |
| 5,313,667 | 5/1994 | Levine | 2/160 |
| 5,414,868 | 5/1995 | Crawford | 2/160 |
| 5,435,273 | 7/1995 | Landis et al. | 2/160 |
| 5,513,391 | 5/1996 | Garneau et al. | 2/161.1 |
| 5,557,805 | 9/1996 | Emerson | 2/161.1 |

FOREIGN PATENT DOCUMENTS

| | | | |
|---|---|---|---|
| 1270602 | 6/1990 | Canada | 2/16 |

*Primary Examiner*—Amy B. Vanatta

*Attorney, Agent, or Firm*—Nixon, Hargrave, Devans & Doyle LLP

[57] ABSTRACT

A device (and method) for securing a glove (or mitten) having two opposing ends and fastener for releasably fastening the opposing ends together to define the first strap as a continuous loop having a circumference extending over the glove around the wrist of the hand. A second strap is provided having a fixed end connected to the first strap and a free end which extends substantially perpendicular from a first part of the continuous loop of the first strap over the glove between two adjacent digits of the hand. The free end of the second strap has a fastener for releasably fastening the second strap to a second part of the continuous loop substantially circumferentially opposite the first part of the continuous loop. In the case where the glove defines a mitten, the above two adjacent digits are the thumb and index finger of the hand. The free end of the second strap of the device may further have a tapered width along a portion of the free end which extends between the two adjacent digits. This portion of the free end is substituted with a plurality of strips, such that each of the plurality of strips extends over the glove between a different set of two adjacent digits of the hand.

16 Claims, 4 Drawing Sheets

DEVICE FOR SECURING A GLOVE OR MITTEN TO THE HAND

DESCRIPTION

FIELD OF THE INVENTION

The present invention relates to a device (and method) for securing a glove or mitten to the hand to prevent the glove or mitten from slipping off the hand. This device is especially suitable for use with small children who during outdoor physical activity have a tendency to lose their gloves or mittens.

BACKGROUND OF THE INVENTION

A common problem with typical gloves or mittens is that they can easily slip off the wearer's hand during physical activity. This is especially a problem with small children. One approach to solving this problem is a mitten fastener described in U.S. Pat. No. 1,361,565, issued Dec. 7, 1920 to Christy. This mitten fastener has an adjustable wristband around the wrist portion of a mitten worn on the hand and a connector strap connected to the wrist band and the mitten via a pin. The connector strap extends perpendicularly from the wristband to the wearer's sleeve and is pinned to the sleeve. This mitten fastener depends on connecting the wrist band to the garment by a connector strap.

Another approach to the above problem was developed for baseball gloves, such as described in U.S. Pat. No. 5,214,798, issued Jun. 1, 1993 to McLaughlin. McLaughlin describes a baseball glove anchor strap having a first wrist strap and a second strap perpendicular to the wrist strap which is secured to the baseball glove through an opening in the back of the glove. This baseball glove anchor strap is not suitable for securing a typical glove or mitten since it requires an opening in the back of the glove or mitten for the finger strap to be secured to.

A further approach to the above problem is to integrate straps into a glove which can secure the glove to the hand. For example, U.S. Pat. No. 5,513,391, issued May 7, 1996 to Garneau et al., describes an anti-slippage glove with a releasable strap system to secure the body of the glove to a wearer's hand. One drawback of this glove is that the strapping system must be designed into the glove and thus is not portable for use with other gloves.

There are other types of gloves having straps integrated into the glove which are not used for securing either a glove or mitten to the hand. For example, U.S. Pat. No. 4,730,354, issued Mar. 15, 1988 to Saito, describes a sporting glove having a single integrated strap to provide a wrist brace for the hand. The integrated strap extends through the glove near the palm, wraps around the wrist and then between the thumb and forefinger. The ends of the strap are connected together. U.S. Pat. No. 5,004,231, issued Apr. 2, 1991 to Alread, describes an exercise glove which is securable to an exercise bar. The glove has an integral wrist strap, and a member which loops from the palm of the glove over an exercise bar to the wrist strap.

Other devices for the hand are wrist supports to brace the wrist and limit wrist movement. For example, wrist supports are shown in: U.S. Pat. No. 3,815,908, issued Jun. 11, 1974 to Hashimoto; U.S. Pat. No. 3,238,939, issued Mar. 8, 1966 to Stubbs; and U.S. Pat. No. 1,790,381, issued Jan. 27, 1931 to Keller. Another device for limiting the motion of the hand is a putting aid for the golfers described in U.S. Pat. No. 5,064,198 issued Nov. 12, 1991 to Szabo. The Szabo putting aid is not used in conjunction with a glove. The finger strap extends from the wrist strap and wraps counter-clockwise around the middle finger and back to the same side of the wrist strap. The tension on the finger strap locks the wrist in a slightly flexed position which improves the putting stroke. This device is not utilized for securing a glove or mitten to the hand, but is designed for fixing the position of the hand while holding a putter shaft.

SUMMARY OF THE INVENTION

Accordingly, it is the principal object of the present invention to provide an improved device and method for securing a glove or mitten on the hand to prevent the glove or mitten from slipping off the hand.

It is another object of the present invention to provide an improved device and method for securing a glove or mitten on the hand which need not be integral with the glove or mitten.

It is further object of the present invention to provide an improved device and method for securing a glove or mitten on the hand which can been used on either the right or left pair of any size glove or mitten without substantially limiting the motion of the hand wearing the glove or mitten.

Briefly described, the present invention embodies a device for securing a glove (or mitten) on a hand to prevent slippage of the glove from the hand. The device has a first strap having two opposing ends and means for releasably fastening the opposing ends together to define the first strap as a continuous loop having a circumference extending over the glove around the wrist of the hand. A second strap is provided having a fixed end connected to the first strap and a free end which extends substantially perpendicular from a first part of the continuous loop of the first strap over the glove between two adjacent digits of the hand. The free end of the second strap has means for releasably fastening the second strap to a second part of the continuous loop substantially circumferentially opposite the first part of the continuous loop. Note that in the case where the glove defines a mitten, the above two adjacent digits are the thumb and index finger of the hand.

The free end of the second strap of the device may further have a tapered width along a portion of the free end which extends between the two adjacent digits. In another embodiment of the present invention, this portion of the free end is substituted with a plurality of strips, such that each of the plurality of strips extends over the glove between a different set of two adjacent digits of the hand.

BRIEF DESCRIPTION OF THE DRAWINGS

The foregoing objects, features, and advantages of the invention will become more apparent from a reading of the following description in connection with the accompanying drawings, in which.

DETAILED DESCRIPTION OF THE INVENTION

Figure 1:
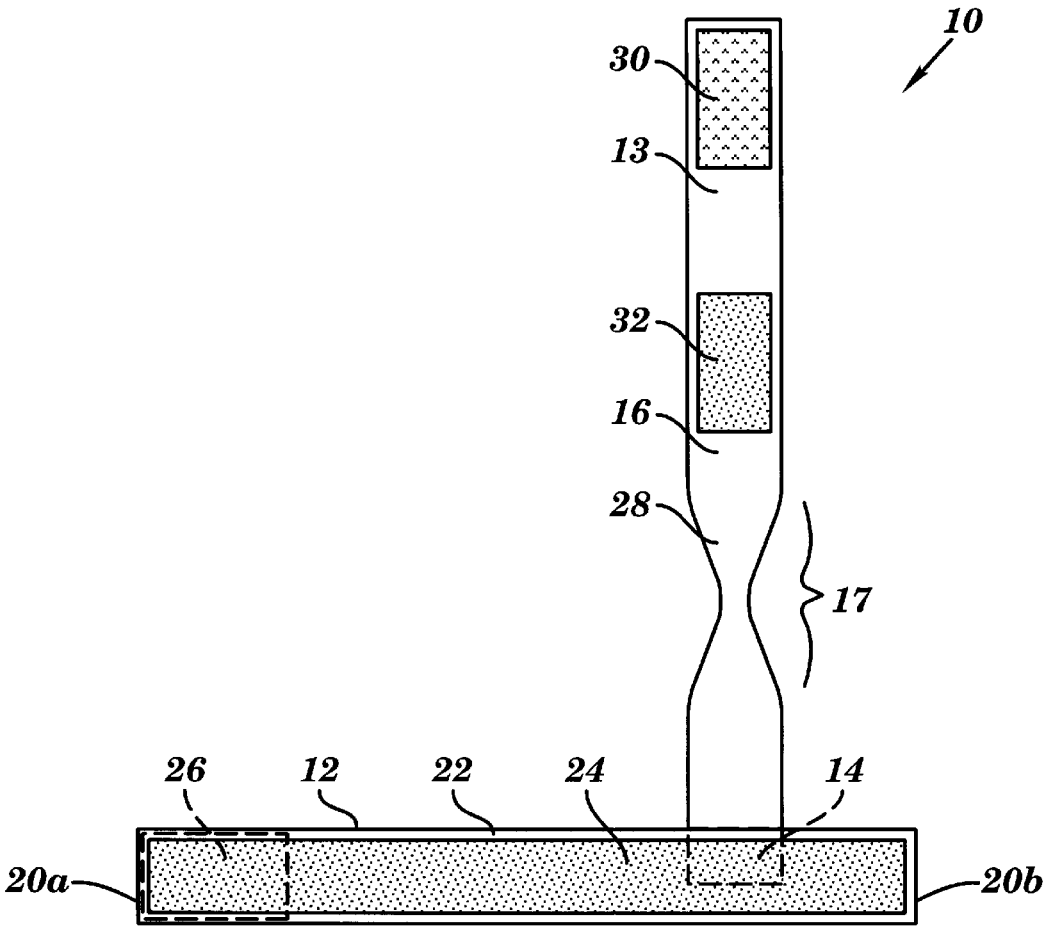
FIG. 1 is plan view of the device of the present invention.

Referring to FIGS. 1, 2, 3A–3D, a device 10 of the present invention is shown having a first strap 12 and a second strap 13. Straps 12 and 13 are made of a flexible material, such as nylon. Strap 13 has a fixed end 14 (shown in dashed lines) attached to strap 12 by stitching, adhesive, or other similar attaching methods. A free end 16 of strap 13 extends substantially perpendicular from strap 12, and has a consistent width along its length, except for its tapered portion 17 in which the width of free end 16 gradually decreases and increases in size. Fixed end 14 may be attached at any point along strap 12, and the location of end 14 with respect to strap 12 shown in the figures is for purposes of illustration.

Figure 2:
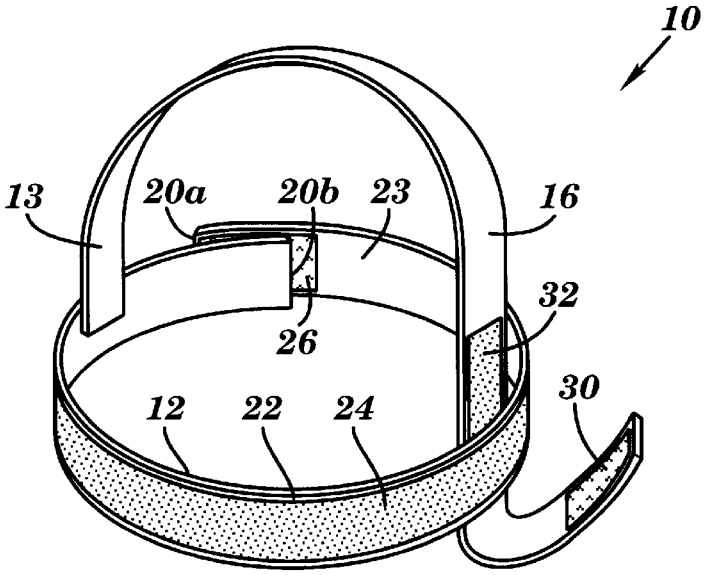
FIG. 2 is a perspective view of the device of the present invention showing where the straps of the device are fastened.

Strap 12 has two opposing ends 20*a* and 20*b*, and front and back surfaces 22 and 23, respectively. Strap 12 also has a hook/pile fastener mechanism, such as VELCRO®, which includes a first patch 24 attached along front surface 22 between ends 20*a* and 20*b*, and a second patch 26 on back surface 23 near end 20*a*. Patches 24 and 26 are each rectangular shaped material having different types of surfaces, preferably, patch 24 has a pile type surface and patch 26 has a hook type surface. The hook type surface has a rough texture and the pile type surface has a soft texture. When ends 20*a* and 20*b* overlap each other to define strip 12 as a continuous loop, as shown in FIG. 2, the surfaces of patches 24 and 26 contact each other and fasten together. By pulling the surfaces of patches 24 and 26 apart, the patches are released from each other.

Strap 13 has a front surface 28 along its free end 16 and also has a hook/pile fastener mechanism, such as VELCRO®, which includes two patches 30 and 32 having different types of surfaces, preferably, patch 30 has a hook type surface and patch 32 has a pile type surface. Patches 30 and 32 are spaced apart from each other and are located on the side of portion 17 opposite fixed end 14. Along strap 13, patch 30 is situated further from fixed end 14 than patch 32. After strap 12 forms a continuous loop as described above, strap 13 extends substantially perpendicular from one part of the continuous loop, at fixed end 14, to approximately the circumferentially opposite part of the loop where it fastens to strap 12 via patches 30 and 32, in which the free end of strap 13 extends under strap 12 and folds around the width of strap 12 such that patch 30 contacts patch 32. By pulling the surfaces of patches 30 and 32 apart, the patches are released from each other.

Figure 3A:
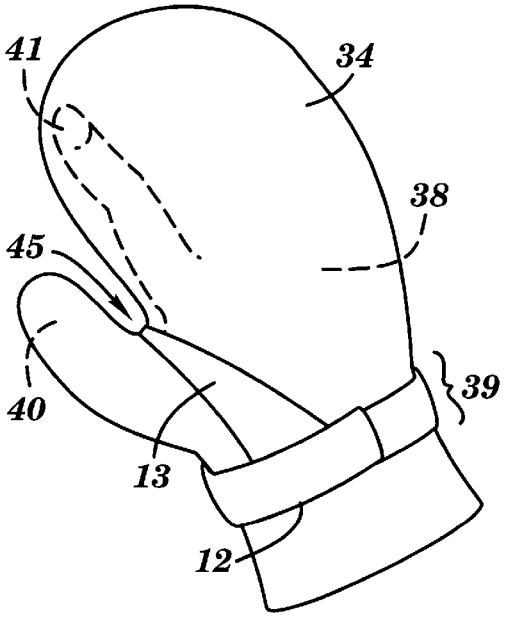
FIGS. 3A and 3B is a plan view of the device of FIG. 1 fastened over a hand wearing a mitten from two different sides, respectively.
Figure 3B:
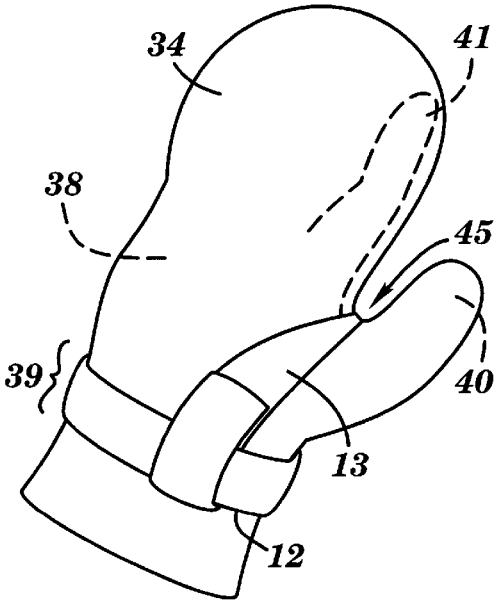
Figure 3C:
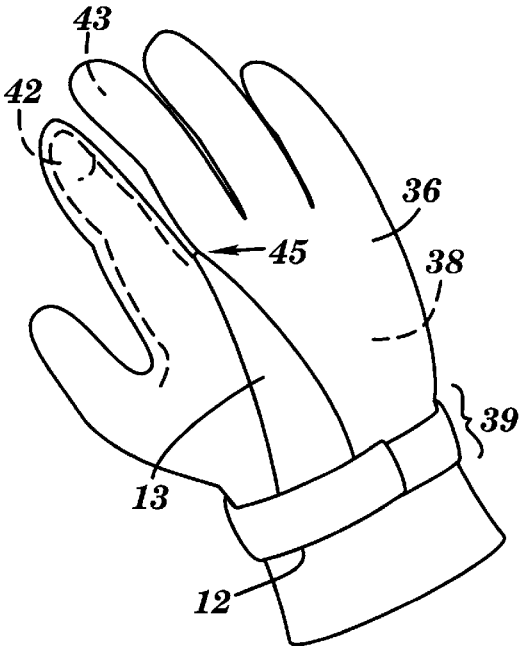
FIGS. 3C and 3D is a plan view of the device of FIG. 1 fastened over a hand wearing a glove from two different sides, respectively.
Figure 3D:
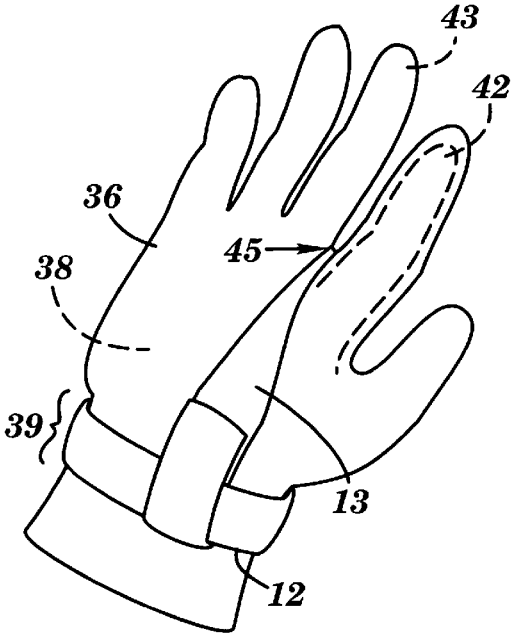

Referring to FIGS. 3A–3D, device 10 is shown securing a mitten 34 or glove 36 to a hand 38. FIGS. 3A and 3C represent the back of hand 38, while FIGS. 3B and 3D represent the front or palm side of hand 38. Although only the right hand is illustrated in the figures, device 10 may be used over a mitten or glove on either the right or left hand. Ends 20*a* and 20*b* of strap 12 overlap over glove 36 or mitten 34 around the circumference of the gloved wrist 39 of hand 38, allowing patches 24 and 26 (FIG. 2) to contact each other and fasten together, thereby securing strap 12 as a continuous loop over the glove or mitten. The amount of overlap of ends 20*a* and 20*b* of strap 12 when patches 24 and 26 contact each other adjusts the size of this loop such that strap 12 fits snugly about gloved wrist 39. Strap 12 is positioned on the back of hand 38 such that the tapered portion 17 of the free end of strap 13 extend from fixed end 14 between two digits (i.e., in the "V" formed at the base of the two gloved digits, for e.g., at 45). For mitten 34 of FIGS. 3A and 3B, these two digits are the thumb 40 and second (index) finger 41, while for glove 36 of FIGS. 3C and 3D, these two digits may be any two adjacent digits of the hand, for example, the second (index) finger 42 and third finger 43. On the front of the hand, the free end of strap 13 passes under strap 12 and folds around strap 12 such that patches 30 and 32 (FIG. 2) contact each other and fasten together to secure strap 13 to the hand.

As shown in FIG. 2, preferably, patch 32 extends along free end 16 longer than patch 30 to allow strap 13 to be adjusted to fit snugly between two digits of different sized hands. Straps 12 and 13 may each be of suitable length for the size of the gloved hand. Alternatively, free end 13 may extend from the continuous loop of strap 12 from the front of the hand between two digits and fasten to strap 12 at the back of the hand.

Figure 4:
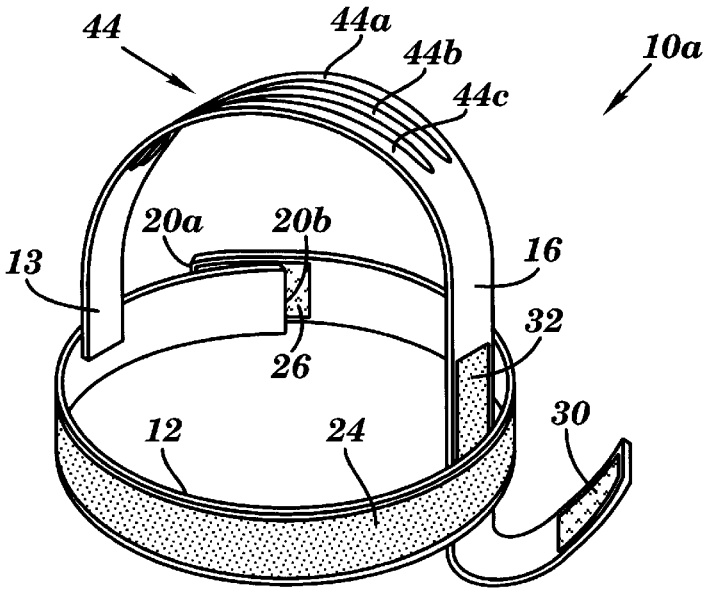
FIG. 4 is a perspective view of the device in accordance with another embodiment of the present invention.
Figure 5A:
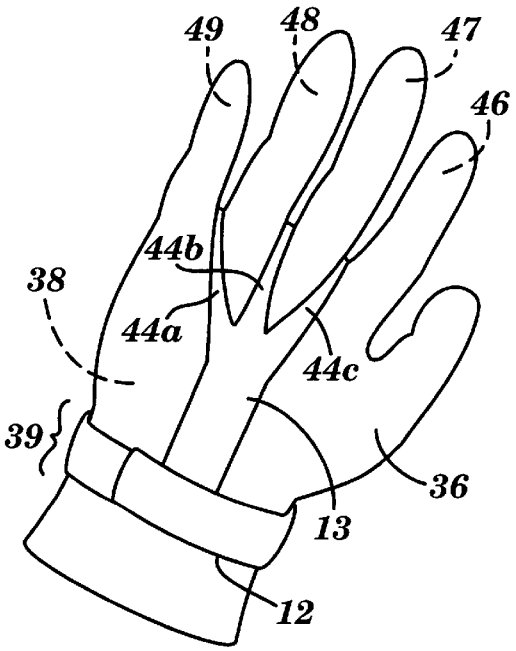
FIGS. 5A and 5B is a plan view of the device of FIG. 4 fastened over a hand wearing a glove from two different sides, respectively, with the second strap having three strips extending between three different sets of adjacent digits of a gloved hand.
Figure 5B:
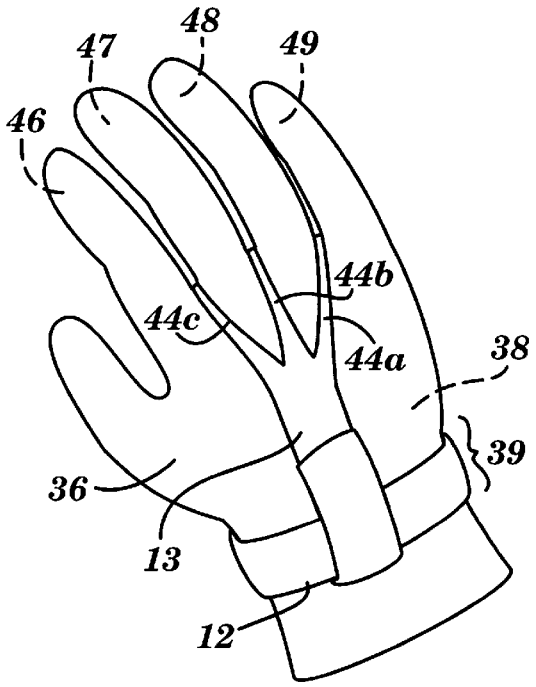
Figure 6A:
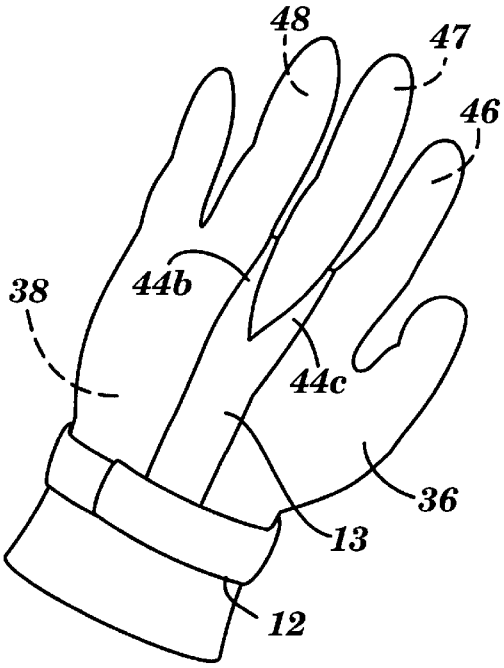
FIG. 6A and 6B is a plan view of the device of FIG. 4 fastened over a hand wearing a glove from two different sides, respectively, but with the second strap having two strips extending between two different sets of adjacent digits of a gloved hand.
Figure 6B:
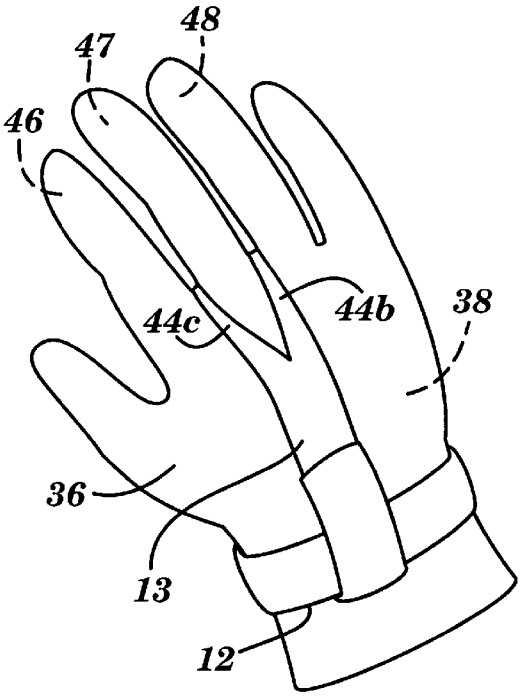

Referring to FIGS. 4, 5A, and 5B, a device 10*a* of a second embodiment of the present invention is shown. Device 10*a* is identical to device 10 except that tapered portion 17 of free end 16 of strap 13 has been substituted with a plurality of strips 44 within free end 16. For example, the plurality of strips 44 may be three strips 44*a*, 44*b*, and 44*c*, as illustrated in the figures. As shown in FIGS. 5A and 5B, showing the front and the back of hand 38, respectively, strips 44*a*, 44*b*, and 44*c* extend between three different sets of two adjacent digits of the hand. For strips 44*a*, 44*b* and 44*c*, respectively, these three sets may be for example: the fourth finger 48 and fifth finger 49; the third finger 47 and fourth finger 48; and, the second (index) finger 46 and third finger 47. FIGS. 6A and 6B also show the front and back of hand 38, respectively, for a gloved hand with device 10*a*, but having only two strips 44*b* and 44*c* extending between two different sets of two adjacent gloved digits of the hand 38. Although only the right hand is illustrated in FIGS. 5A, 5B, 6A and 6B, device 10*a* may be used over a glove on either the right or left hand.

By proper adjustment of straps 12 and 13 to fit snugly over glove 36 or mitten 34, device 10 may be used over the right or left hand of the right or left pair, respectively, of any size glove 36 or mitten 34 without substantially limiting the motion of the hand wearing the glove or mitten. Similarly, device 10*a* may be used over the right or left hand of the right or left pair, respectively, of any size glove 36 without substantially limiting the motion of the hand. Further, device 10 or device 10*a* may be integrated into a particular glove or mitten, however preferably, they are separate from a glove or mitten.

From the foregoing description it will be apparent that there has been provided an improved device and method for securing a glove or mitten to the hand to prevent the glove or mitten from slipping off the hand. Variations and modifications of the herein described device or method and other applications for the invention will undoubtedly suggest themselves to those skilled in the art. Accordingly, the foregoing description should be taken as illustrative and not in a limiting sense.

What is claimed is:

1. A system comprising:

a covering for a hand;

a first strap;

a first fastener for releasably fastening the first strap over the covering around a wrist of the hand;

a second strap connected to the first strap and having a free end which extends over the covering and between two adjacent digits of the hand and;

a second fastener for releasably fastening said second strap to the first strap.

2. The system of claim 1 wherein the covering is a mitten and the two adjacent digits are the thumb and index finger of the hand.

3. The system of claim 1 wherein the free end of the second strap has a tapered width along a portion of the free end which extends between the two adjacent digits.

4. The system of claim 1 wherein the first strap has front and back surfaces and the first fastener comprises:

a hook patch on the back surface of the first strap at one end of the first strap; and a loop patch along the front side of the first strap, wherein the hook patch and the loop patch contact each other to fasten the first strap around the covering.

5. The system of claim 1 wherein the second strap has a front surface and the second fastener for releasably fastening the second strap to the first strap comprises hook and loop patches on the front surface of the free end of the second strap, wherein the hook and loop patches are spaced from each other enabling the one of the hook and loop patches to extend under the first strap and fold over the first strap to contact the other of the hook and loop patches and fasten the second strap to the first strap at the second part of the continuous loop of the first strap.

6. The system of claim 1 wherein the free end of the second strap has a portion having a plurality of strips, and each of the plurality of strips extends over the glove between a different set of two adjacent digits of the hand.

7. The system of claim 1 wherein the covering is a glove.

8. A method comprising the steps of:

donning a covering on a hand;

providing a first strap;

fastening the first strap over the covering around a wrist of the hand;

providing a second strap connected to the first strap and having a free end;

extending the second strap over the covering and between two adjacent digits of the hand; and fastening the free end of the second strap to the first strap.

9. The method of claim 8 wherein the covering is a mitten and the two adjacent digits are the thumb and index finger of the hand.

10. The method of claim 8 wherein the step of extending the second strap further comprises the step of:

extending a portion of the second strap having a plurality of strips over the covering between a different set of two adjacent digits of the hand.

11. The method of claim 8 wherein the step of fastening the first strap further comprises the step of:

adjusting the size of the first strap to fit snugly over the gloved wrist.

12. The method of claim 8 wherein the step of fastening the second strap further comprises the step of:

adjusting the length of the second strap to fit snugly between the two digits of the hand.

13. The method of claim 8 wherein the covering is a glove.

14. A device for securing a covering on a hand comprising:

a first strap having opposing ends;

a first fastener for releasably fastening the opposing ends together when the first strap is positioned over the covering around the wrist of the hand; and a second strap connected to the first strap and having a free end which extends from a first part of the first strap over the covering and between two adjacent digits of the hand, the free end of the second strap having a second fastener for releasably fastening the second strap to a second part of the first strap, the free end of the second strap having a portion with a plurality of strips, each of the plurality of strips extends over the covering between a different set of two adjacent digits of the hand.

15. The device according to claim 14 wherein one or more of the strips have a tapered width along a portion which extends between two adjacent digits.

16. A method for securing a covering on a hand comprising the steps of:

providing a first strap having opposing ends;

extending the first strap over the covering around a wrist of the hand;

fastening the opposing ends of the first strip together;

providing a second strap connected to the first strap, the second strap having a portion with a plurality of strips and a free end;

extending the second strap over the covering with each of the strips being positioned between a different set of two adjacent digits of the hand; and fastening the free end of the second strap to the first strap.

* * * * *